US006947809B2

(12) United States Patent
Ren et al.

(10) Patent No.: US 6,947,809 B2
(45) Date of Patent: Sep. 20, 2005

(54) METHOD OF MODIFYING STAMPING TOOLS FOR SPRING BACK COMPENSATION BASED ON TRYOUT MEASUREMENTS

(75) Inventors: Feng Ren, Canton, MI (US); Zhiyong Cedric Xia, Canton, MI (US)

(73) Assignee: Ford Global Technologies, Dearborn, MI (US)

( * ) Notice: Subject to any disclaimer, the term of this patent is extended or adjusted under 35 U.S.C. 154(b) by 0 days.

(21) Appl. No.: 10/248,958

(22) Filed: Mar. 5, 2003

(65) Prior Publication Data

US 2004/0176863 A1 Sep. 9, 2004

(51) Int. Cl.[7] ..... G06F 19/00
(52) U.S. Cl. ..... 700/163; 700/98; 700/118
(58) Field of Search ..... 700/98, 118, 163, 700/143, 146, 147, 195, 206

(56) References Cited

U.S. PATENT DOCUMENTS

| | | | | |
|---|---|---|---|---|
| 4,373,371 A | | 2/1983 | Liu | |
| 4,802,357 A | | 2/1989 | Jones | |
| 4,989,439 A | | 2/1991 | Ewert et al. | |
| 6,013,997 A | * | 1/2000 | Heideman et al. | 318/648 |

OTHER PUBLICATIONS

Longwu Wu "Tooling Mesh Generation Technique for Interative FEM Die Surface Design Algorithm to Compensate for Springback in Sheetmetal Stamping", Engineering Computations, vol. 14, No. 6, 1997,pp. 630–648; MCB University Press.*

A.P. Karafillils and M.C. Boyce: Tooling Design in Sheet Metal Forming Using Springback Calculations; Int. J. Mech. Sci, vol. 34, No. 2, pp. 113–131, 1992; Pergamon Press, pic.

Apostolos P. Karafillis and Mary C. Boyce; Tooling and Binder Design for Sheet Metal Forming Processes Compensating Springback Error; Int. J. Mach. Tools Manufact., vol. 36, No. 4, pp. 503–526, 1996, Pergamon.

Longwu Wu; Tooling Mesh Generation Technique for Interative FEM Die Surface Design Algorithm to Compensate for Springback in Sheetmetal Stamping; Engineering Computations, vol. 14, No. 6, 1997, pp. 630–648; MCB University Press.

* cited by examiner

*Primary Examiner*—Paul L Rodriguez
*Assistant Examiner*—Carlos Ortiz Rodriguez
(74) *Attorney, Agent, or Firm*—David B. Kelley; Dykema Gossett

(57) ABSTRACT

A method of developing a stamping die for a workpiece is provided, which includes the steps of stamping a workpiece in a current die. A measurement is made of the stamped workpiece to determine its profile. The profile is compared with the design intent workpiece to determine dimensional variance. If the variance is within predetermined limits, the development is complete. If the variance is beyond limits, a conceptual determination is made of the residual forces in the current die stamped workpiece when the current die stamped workpiece is restamped by a design intent die. This conceptual determination is carried out on a computer. From the determination of residual forces, a new current die is developed. The new current die then stamps the workpiece. The steps are repeated until the stamped workpiece profile is within predetermined limits.

6 Claims, 4 Drawing Sheets

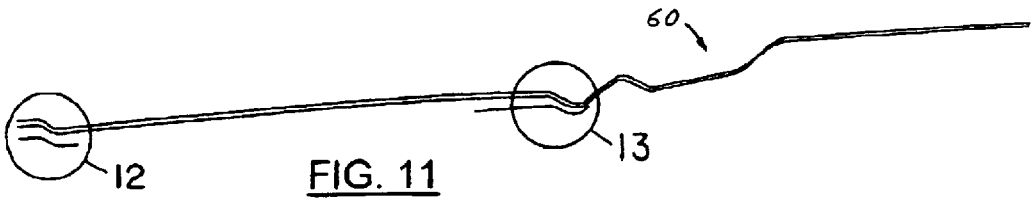
FIG. 11
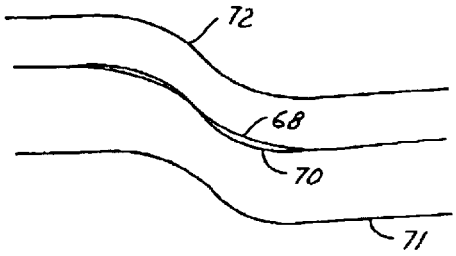
FIG, 12
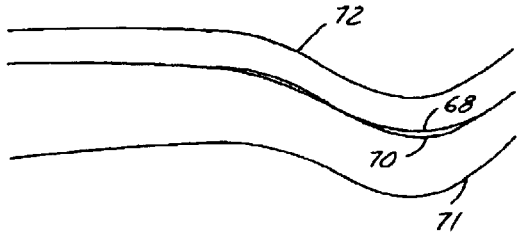
FIG. 13

METHOD OF MODIFYING STAMPING TOOLS FOR SPRING BACK COMPENSATION BASED ON TRYOUT MEASUREMENTS

BACKGROUND OF INVENTION

1. Field of the Invention

The field of the present invention is designing dies for stamping sheet metal parts. More particularly the present invention relates to designing dies for stamping sheet metal parts which compensate for the tendency of sheet metal parts to spring back after a stamping operation, so that the part process from the die will more exactly match a design intent profile of a part.

2. Background of the Invention

Most automotive vehicles have a plurality of metal stampings which are utilized both in the chassis and automotive vehicle body. In many instances the stamping workpiece starts out as a thin sheet of metal. The metal is pressed between two dies which form the workpiece in the desired configuration. After the stamping operation, the workpiece is trimmed and delivered to another workstation for further metal working operations or assembly with the vehicle. The stamping operation forms the workpiece by plastic deformation. However, some of the deformation which occurs to the workpiece will still be elastic in nature. Therefore, after removal from the dies, certain portions of the workpiece will tend to elastically deform to relieve the residual stress. This relieving of residual stress is often referred to as spring back. Trial and error has taught tool designers that for a predetermined workpiece profile, the die utilized to stamp the workpiece must be modified so that the workpiece will spring back after pressing to form a workpiece within predetermined dimensional limitations.

Prior to the present invention, most of this compensation in die design to accommodate spring back was a function of the knowledge and experience of the tool and die designer. Often the above-noted process of trial and error caused a major expense due to design and redesign of dies. The prior trial and error method also required significant expenditures of time.

Attempts have been made to mathematically quantify the design process of stamping dies to be less dependent upon the knowledge and experience of a tool and die maker. Many of the prior mathematical computational methods of designing dies which could accommodate for spring back require the utilization of computers with a larger amount of power and also require extensive amounts of time to bring forth satisfactory results. Another problem with many prior predictive techniques is that they fail to converge in some circumstances, such as in case of complex tooling geometries or in case of different materials. For example, if a first iteration of the predicted die surface was corrected too far so that the die would form a part that was over bent, the predicted technique could not converge back to provide a die which would form a workpiece in a non over bent condition.

Another problem with prior predictive techniques was lack of a good method to start out with an initial corrected die which differed in profile from the design intent profile of the workpiece. Experience has taught those in tool die arts that certain modifications will be needed. Therefore, it is desirable to start out with a mathematical technique which can predict results starting out with a die which has already been modified from a profile of a design intent workpiece.

Still another problem with prior predictive techniques was that there was no way to take advantage of empirical data which was generated from actual tryout dies.

It is desirable to provide a method of designing a stamping die which can accommodate needed changes due to the spring back characteristic of the stamped metal workpiece in shorter time intervals with more predictable results. It is further desirable to provide a method of designing a stamping die wherein the predicted result converges to a more accurate solution. It is still further desirable to provide a method of designing a stamping die which can take advantage of empirical data gathered from tryout dies.

SUMMARY OF INVENTION

The present invention provides a method of developing a stamping die for a design intent three-dimensional profile workpiece. The method includes the steps of stamping a workpiece of material in a current die. A measurement is made of the stamped workpiece to determine the profile. The profile is compared with the profile of the design intent workpiece to determine the extent of any dimensional variance. If the dimensional variance is within predetermined limits, the current die is designated as the final die. If the variance is beyond predetermined limits, a conceptual determination is made of the residual forces in the current die stamped workpiece when the current die stamped workpiece is restamped by a die configured by the design intent three-dimensional profile of the workpiece. This conceptual determination is usually carried out on a computer by numerical methods, such as finite element analysis. From the determination of residual forces, the residual forces are reversed to develop a new current die. The new current die is then utilized to stamp the workpiece metal. The aforementioned steps are repeated until the workpiece made by the current die has a dimensional variance with the design intent workpiece which is within predefined limits.

The above-noted and other advantages of the present invention will become more apparent to those skilled in the art as the invention is further revealed by a review of the drawings and the accompanying detailed description.

BRIEF DESCRIPTION OF DRAWINGS

FIG. 11 is a section view taken along lines 11—11 of FIG. 4.

FIG. 12 is an enlargement of circled portion 12 of FIG. 11.

FIG. 13 is an enlargement of circled portion 13 of FIG. 11.

DETAILED DESCRIPTION

Figure 1:
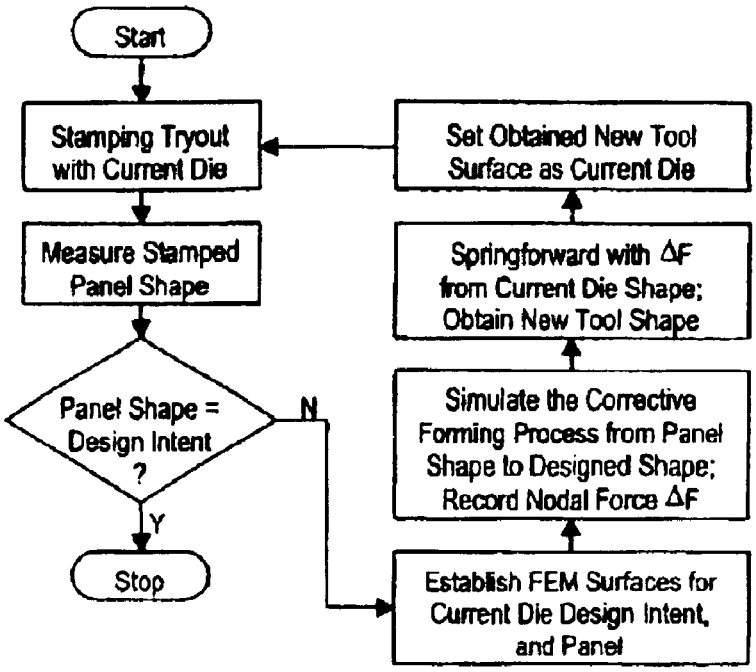
FIG. 1 is a flow chart illustrating the method of developing a stamping die according to the present invention.
Figure 2:
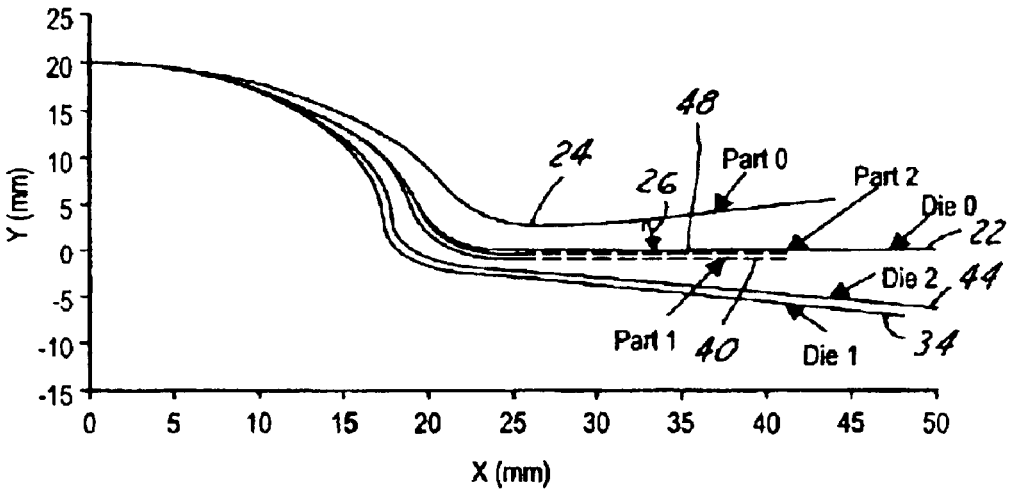
FIG. 2 is an enlargement illustrating a profile of a die in a stamped workpiece utilizing the method shown in FIG. 1.
Figure 3:
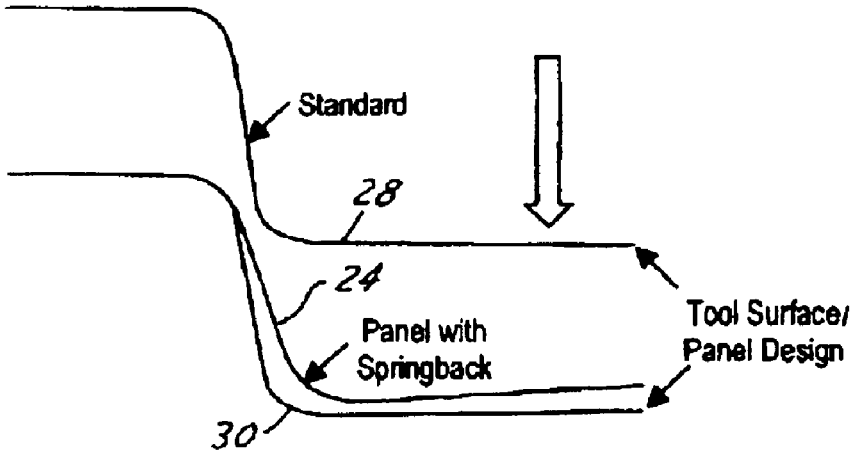
FIG. 3 is a schematic view of a simulation of the corrective forming process shown in FIG. 1.

Referring to FIGS. 1–3, a part having a profile is shown by the line 22 (Die 0). Line 22 denotes a sectional line taken through a three-dimensional part. In the start of the process, a stamping tryout is made using a test or current die. The workpiece will typically start out as a flat sheet of material. The panel or current die, also referred to Die 0, can have a profile that is identical to the profile of the design intent workpiece or may have a profile which has some initial modifications. After stamping, the workpiece is removed from the die. The workpiece initially has a profile shown by line 24 (Part 0). This profile will be measured by appropriate means including but not limited to optical scanning techniques. Another technique is to use a coordinate measuring machine. A coordinate measurement machine has a needle-type contact point which travels along the surface to measure its geometry. Between the lines 22 and 24 is a spring back, FIG. 2, item 26.

A comparison is made to determine a dimensional variance between the part noted by line 24 and the profile of the design intent part noted as line 22. This variance in profile will be made in all three dimensions. If the variance is within predetermined limits then the current die is designated as the final die. The process is now complete.

If the variance is beyond the pre-determined limits, then further steps must occur. A non-linear finite element method is utilized to analyze the profile of the stamped workpiece. A non-linear finite element method is also utilized to make an analysis of the surface of the current die which in the example is formed having a profile equal to the design intent part.

The current die stamped part, FIG. 2, item 24 is conceptually stamped by upper and lower standard die members 28 and 30 usually simulated on a computer with finite element analysis or other numerical methods. The upper and lower members 28 and 30 are configured to have a profile which is identical to the design intent profile of the workpiece. This would be the case even if the initial current die had a different configuration. From this conceptual step, the residual forces will be noted in the workpiece when the upper and lower members 28 and 30 of the conceptual die are brought together. These residual forces will be reversed in the profile of the current die to develop a new current die, FIG. 2, line 34.

The new current die is developed to obtain a workpiece with a reversal of the residual stresses noted in the process shown in FIG. 3. A new workpiece is stamped using the new current die. A result of that is shown as Part 1 or line 40. The profile of the workpiece as stamped by the current die, Die 1, has a negative spring back; that being the workpiece (Part 1) is over bent. Again, a comparison is made between the three-dimensional profile of the workpiece (line 40) and the profile of the design intent workpiece as noted by item 22. Since the dimensional variance is greater than desired, the process continues. The workpiece noted by line 40 is again conceptually stamped by the process shown in FIG. 3. The residual stresses which are negative springback are then incorporated into the design of the new current die generating a new current die noted as Die 2 or line 44. Again, a workpiece is stamped with the current die noted as line 44. The workpiece has a profile as noted by line 48. The profile of the workpiece is very close to the profile of the design intent workpiece and is within predetermined limits, therefore the current die, Die 2 will be designated as the final die.

Figure 4:
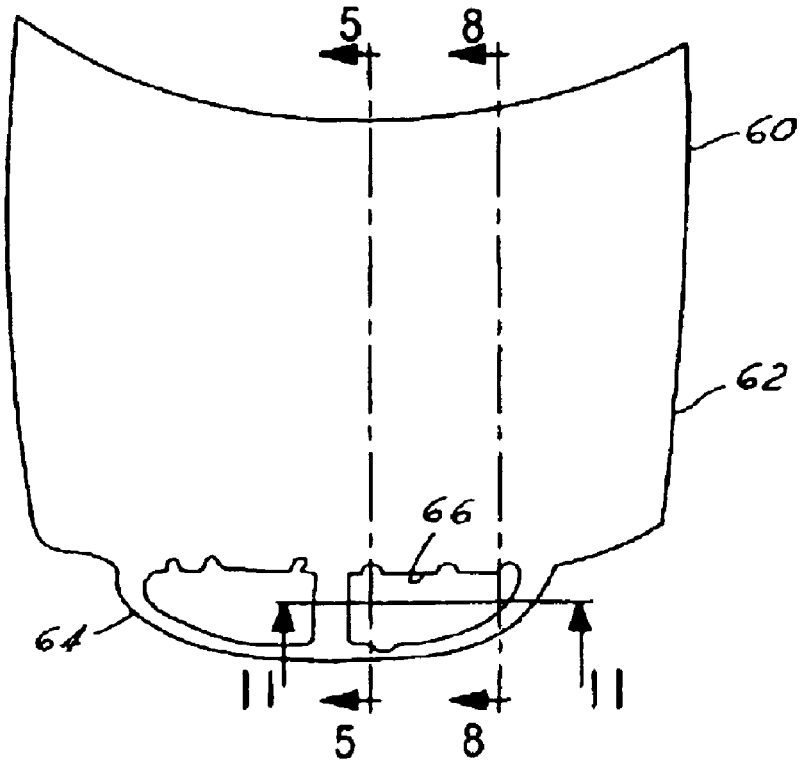
FIG. 4 is a top plan view of a hood panel that is stamped in a die developed according to the present invention.
Figure 5:
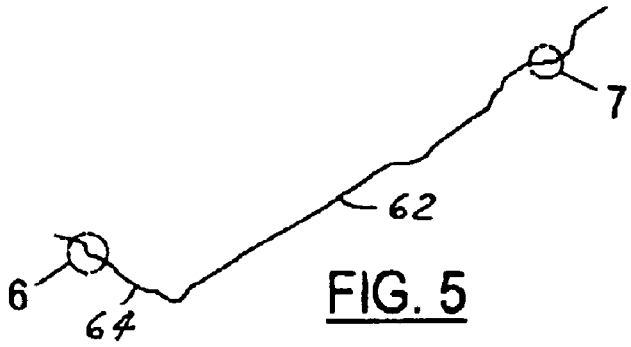
FIG. 5 is a sectional view taken along lines 5—5 of FIG. 4.
Figure 6:
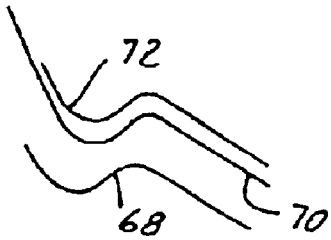
FIG. 6 is an enlargement of circled portion 6 of FIG. 5.
Figure 7:
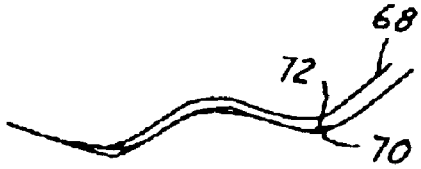
FIG. 7 is an enlargement of circled portion 7 of FIG. 5.
Figure 8:
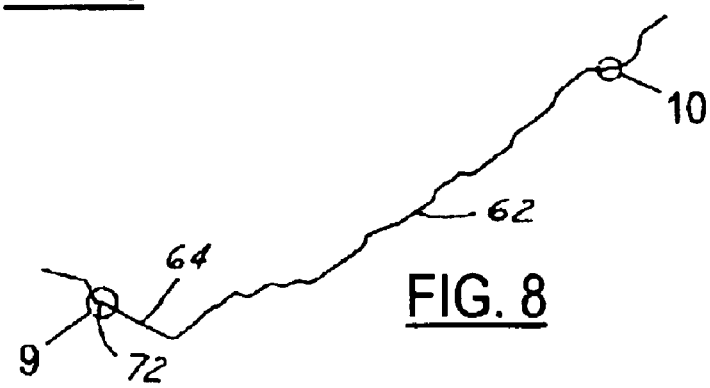
FIG. 8 is a sectional view taken along lines 8—8 of FIG. 4.
Figure 9:
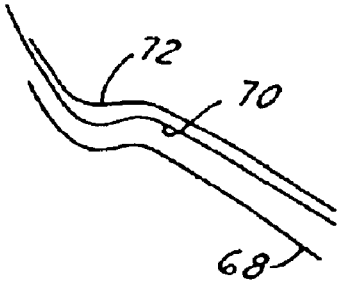
FIG. 9 is an enlargement of circled portion 9 of FIG. 8.
Figure 10:
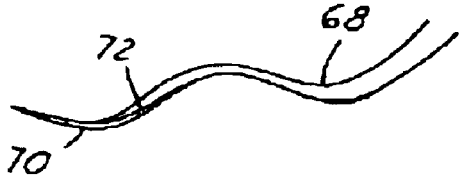
FIG. 10 is an enlargement of circled portion 10 of FIG. 8.

Referring to FIGS. 4–13, an example of the present inventive method and its results are shown. FIG. 4 is a top elevational view of an inner hood panel 60 having a generally horizontal portion 62 and a generally vertical front end portion 64 with radiator grill cutouts 66. Referring to section lines 5—5, 8—8, and 11—11, line 68 represents the sheet metal of the panel that has been stamped and that is in its springback position. The panel represented by line 68 has a three-dimensional profile within the predetermined variance limits of the design intent part. Line 70 illustrates the surface profile of the original die shape. Line 71 illustrates the sheet metal of the panel with spring back after actual stamping with the initial die (configured to the design intent profile of the original part). Line 72 illustrates the surface profile of the die which has been compensated with the present inventive method.

FIGS. 12 and 13 more clearly demonstrate the improvement between the profile of the original stamped workpiece 71 and the compensated die stamped workpiece 68.

Various embodiments of the present invention have been shown, however, it will be apparent to those skilled in the art of the various changes and modifications which can be made without departing from the spirit or scope of the invention as it is defined by the accompanying claims.

What is claimed is:

1. A method of developing a stamping die for a design intent three-dimensional profile workpiece comprising the steps of:

(1) stamping a workpiece of material in a current die;

(2) measuring the current die stamped workpiece to determine a three-dimensional profile of the stamped workpiece;

(3) comparing the current die stamped workpiece profile to the design intent workpiece profile to determine if a positive or negative variance between the profiles is within predetermined limits and designating the current die as the final die if the profile variance is within the predeteimined limits;

(4) determining the residual forces in the stamped workpiece when the current die stamped workpiece is conceptually stamped by a standard die configured by the design intent three-dimensional profile of the workpiece if the profile positive or negative variance is not within the predetermined limits;

(5) reversing the determined residual forces in the current die stamped workpiece to develop a new current die; and repeating steps (1)–(5), until the profile variance of the current die stamped workpiece is within the predetermined limits.

2. A method of developing a stamping die as defined in claim 1 wherein an initial current die has a surface profile identical to the design intent profile of the workpiece.

3. A method as described in claim 1 wherein an initial current die is a die having a surface profile which has modifications from the design intent profile of the workpiece.

4. A method of developing a stamping die as defined in claim 1, wherein the measuring of the current die stamp workpiece is performed utilizing an optical scanner.

5. A method as described in claim 1 wherein the measuring of the current die stamp workpiece to determine a three dimensional profile is performed utilizing a coordinate measurement machine.

6. A method of developing a stamping die for a design intent three-dimensional profile workpiece comprising the steps of:

(1) stamping a workpiece of material in a current die, the current die having a profile modified from the design intent three-dimensional profile;

(2) measuring the current die stamped workpiece to determine a three-dimensional profile of the stamped workpiece;

(3) optically comparing the current die stamped workpiece profile to the design intent workpiece profile to determine if a positive or negative variance between the profiles is within predetermined limits and designating the current die as the final die if the profile variance is within the predetermined limits;

(4) determining the residual forces in the stamped workpiece when the current die stamped workpiece is conceptually stamped by a standard die configured by the design intent three-dimensional profile of die workpiece if the profile positive or negative variance is not within the predetermined limits;

(5) reversing the determined residual forces in the current die stamped workpiece to develop a new current die; and repeating steps (1)–(5), until the profile variance of the current die stamped workpiece is within the predetermined limits.

* * * * *